US006863697B2

(12) United States Patent
McDaniel et al.

(10) Patent No.: US 6,863,697 B2
(45) Date of Patent: Mar. 8, 2005

(54) PROCESS FOR ENHANCING THE ABSORBENCY OF A FABRIC HAVING CONJUGATE YARNS

(75) Inventors: John Scott McDaniel, Greenville, SC (US); Kirkland W. Vogt, Greenville, SC (US); Woodrow P. Gilbert, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 74 days.

(21) Appl. No.: 10/071,316

(22) Filed: Feb. 8, 2002

(65) Prior Publication Data

US 2003/0150063 A1 Aug. 14, 2003

(51) Int. Cl.[7] ..... D06M 11/36

(52) U.S. Cl. ..... 8/115.56; 8/115.54; 8/115.68; 8/115.69; 442/361

(58) Field of Search ..... 8/115.54, 115.56, 8/115.68, 115.69; 442/361

(56) References Cited

U.S. PATENT DOCUMENTS

| | | | | | |
|---|---|---|---|---|---|
| 3,516,239 | A | * | 6/1970 | Fukuda et al. | |
| 4,018,646 | A | | 4/1977 | Ruffo et al. | 162/146 |
| 4,367,070 | A | * | 1/1983 | Hayashi et al. | |
| 4,415,331 | A | | 11/1983 | Dusenbury et al. | 8/114.6 |
| 4,460,649 | A | * | 7/1984 | Park et al. | 428/373 |
| 5,225,263 | A | | 7/1993 | Baravian et al. | 428/95 |
| 5,688,582 | A | | 11/1997 | Nagaoka et al. | 428/198 |
| 5,899,785 | A | | 5/1999 | Groten et al. | 442/334 |
| 5,970,583 | A | | 10/1999 | Groten et al. | 19/296 |
| 2002/0013111 | A1 | | 1/2002 | Dugan et al. | 442/335 |
| 2003/0003826 | A1 | | 1/2003 | Rudisill et al. | 442/36 |

* cited by examiner

*Primary Examiner*—Margaret Einsmann
(74) *Attorney, Agent, or Firm*—Terry T. Moyer; Charlotte C. Wilson

(57) ABSTRACT

In a preferred embodiment, the present process involves subjecting a fabric having splittable conjugate yarns both to an acidic treatment and to a basic treatment, each of which erodes a portion of the components of the conjugate yarns. The acid treatment, given certain reaction kinetics, removes a portion of the polyamide element of the conjugate filament. The basic treatment has a similar effect on the polyester element of the conjugate filament, making it more hydrophilic. The at least partial removal of the polyamide component, coupled with the increased hydrophilicity of the polyester component, results in a fabric having enhanced absorptive properties. In an alternate embodiment, treatments with only acid or only basic solution may be employed.

24 Claims, 3 Drawing Sheets

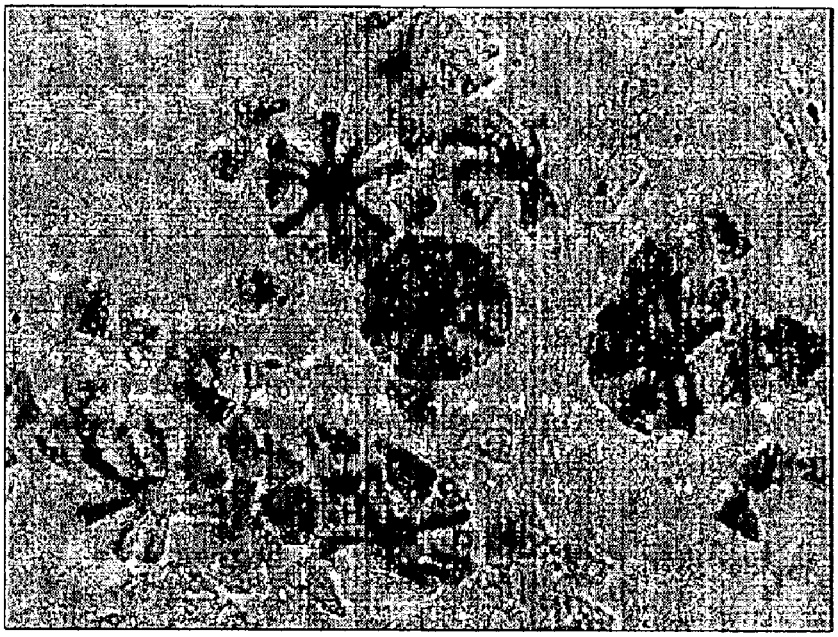
FIG. –1–
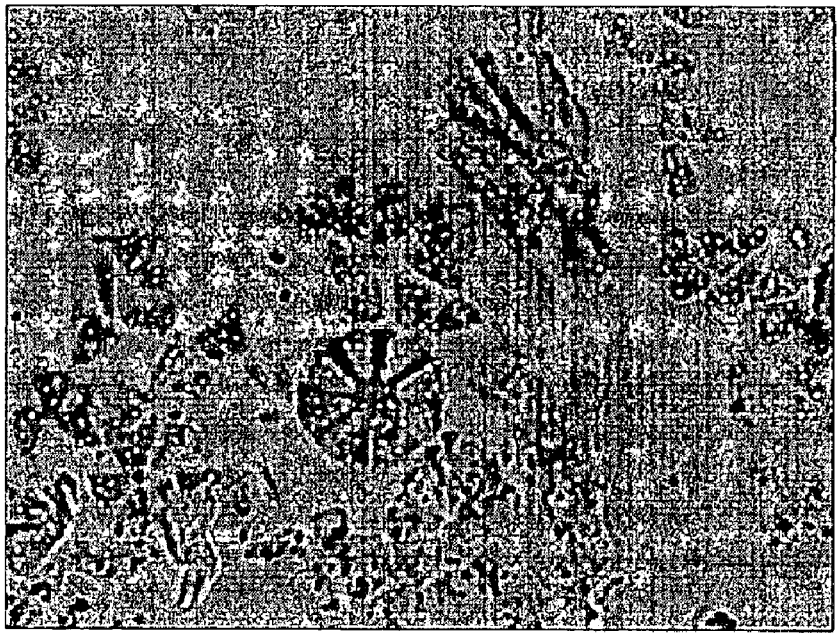
FIG. –2–

PROCESS FOR ENHANCING THE ABSORBENCY OF A FABRIC HAVING CONJUGATE YARNS

TECHNICAL FIELD

This disclosure relates to a treated fabric that is comprised of splittable conjugate yarns and to a process for modifying such a fabric to enhance its water absorbency. Specifically, the present invention relates to a consolidated nonwoven fabric containing continuous filaments comprised of polyester and polyamide components, in which portions of at least one of the components have been removed. The process used to remove portions of the polyamide component involves treating the fabric with acid. A basic solution is used to remove portions of the polyester component of the fabric. The result, using either or preferably both treatments, is a nonwoven fabric with a much greater ability to absorb water. Contemplated end uses of such a treated fabric are also provided.

BACKGROUND

As will be discussed herein, the present process is applicable to any conjugate yarn that includes a polyamide as one of its components. The present process improves the absorption characteristics of fabrics of any construction (woven, knit, or nonwoven) that are comprised of microdenier yarns that result from splitting conjugate multi-component yarns. Microdenier fabrics are traditionally created by mechanically or chemically splitting a conjugate yarn into its elementary filaments. Although the benefits of this process are readily apparent on a specific nonwoven fabric that will be discussed in detail herein, it should be understood that it is equally applicable to woven or knitted microdenier fabrics created from splittable yarns.

Nonwovens are known in the industry as an alternative to traditional woven or knit fabrics. To create a nonwoven fabric, a fibrous web must be created and then consolidated. Staple fibers are formed into a web through the carding process, which can occur in either wet or dry conditions. Alternatively, continuous filaments, which are formed by extrusion, may be used in the formation of a web. The web is then consolidated and bonded by means of needle-punching, point-bonding, chemical bonding, or hydroentangling. A second bonding technique may also be employed.

A preferred substrate for the present disclosure is a nonwoven formed of continuous splittable filaments that are extruded as a web and then consolidated. The continuous conjugate filaments are obtained by means of a controlled spinning process. The continuous filaments have the following characteristics: (1) the continuous filaments are comprised of at least two elementary filaments and at least two different fiber types; (2) the continuous filaments are splittable along at least a plane of separation between elementary filaments of different fiber types; (3) the continuous filaments have a filament number (that is, titer or yarn count) of between 0.3 dTex and 10 dTex; and (4) the elementary filaments of the continuous filament have a filament number between 0.005 dTex and 2 dTex. Simply put, the nonwoven fabric can be described as a nonwoven fabric made from conjugate filaments. Such a fabric is described in U.S. Pat. Nos. 5,899,785 and 5,970,583, both to Groten et al., each of which is incorporated herein by reference.

A wide range of synthetic materials may be utilized to create the elementary filaments of the continuous conjugate filaments. The conjugate filaments used the present process differ from those common in the art in that they are comprised of elementary filaments of different polymer types. Such polymer types may include polyesters, polyamides, polyolefins, polyurethanes, and the like.

However, the present invention is intended to improve the characteristics of fabrics that contain polyesters or polyamides as part of the conjugate yarns. As such, the group of polymer materials forming the elementary filaments is selected from among the following groups: polyester and polyamide; polyolefin and polyamide; polyurethane and polyamide; polylactic acid and polyamide; polyester, polyolefin, and polyamide; and polyester, polyolefin, polyurethane, and polyamide; or any other combination as may be known in the art.

It is desirable in the nonwoven fabrics described above to fully split, or separate, the elementary filaments of the continuous filaments from one another. The same goal applies to woven or knitted fabrics as well. The resultant microdenier strands contribute to the textile quality of the nonwoven fabric. The microdenier yarns contribute to the softness and hand of woven or knitted fabrics.

However, the fabric described in the above-referenced patents is not as absorbent as many other synthetic fabrics that may be used in the drying or wiping cloth market and that may have a similar composition but different construction. The nonwoven of the present disclosure is more absorbent after being subjected to the present process.

SUMMARY

In a preferred embodiment, the present process involves subjecting a fabric having splittable conjugate yarns both to an acidic treatment and to a basic treatment, each of which erodes a portion of the components of the conjugate yarns. The acid treatment, given certain reaction kinetics, removes a portion of the polyamide element of the conjugate filament. The basic treatment has a similar effect on the polyester element of the conjugate filament, making it more hydrophilic. The at least partial removal of the polyamide component, coupled with the increased hydrophilicity of the polyester component, results in a fabric having enhanced absorptive properties. In an alternate embodiment, treatments with only acid or only basic solution may be employed.

BRIEF DESCRIPTION OF THE DRAWINGS

The following photographs were taken with a Hitachi Camera, Model VK-C350, after having been magnified through an Olympus BH2 optical microscope. The following photographs are of various fabric cross-sections.

FIG. 1 is a photograph, taken by an optical microscope at a magnification of 1060×, of a nonwoven fabric that has been dyed but not subjected to the present process;

FIG. 2 is a photograph, taken by an optical microscope at a magnification of 1060×, of a nonwoven fabric that has been subjected only to the acid treatment of the present process;

DETAILED DESCRIPTION

Figure 3:
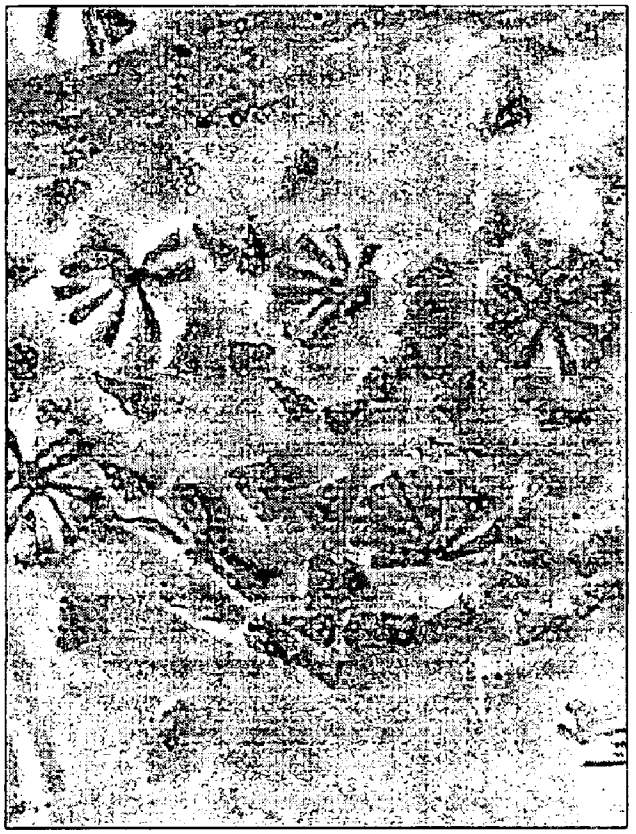
FIG. 3 is a photograph, taken by an optical microscope at a magnification of 1060×, of a nonwoven fabric that has been subjected only to the basic treatment of the present process.

The present product is created by subjecting a fabric comprised of splittable continuous conjugate filaments to successive treatments with acid and base. The resultant treated fabric has enhanced ability to absorb water, as compared with the untreated fabric and other drying cloths made of similar synthetic materials.

The present process includes the steps of: (a) treating the fabric with acid and rinsing; and (b) treating the fabric with base and rinsing. In one preferred embodiment, before treatment with acid or base, the fabric is subjected to high pressure hydroentanglement, as described in U.S. patent application Ser. No. 09/344,596, filed Jun. 25, 1999, which is commonly owned and is hereby incorporated by reference.

The term "polyamide" is intended to describe any long-chain polymer having recurring amide groups (—NH—CO—) as an integral part of the polymer chain. Examples of polyamides include nylon 6, nylon 66, nylon 11, and nylon 610.

The term "polyester" is intended to describe any long-chain polymer having recurring ester groups (—C(O)—O—). Examples of polyesters include aromatic polyesters such as polyethylene terephthalate (PET), polybutylene terephthalate (PBT), and polytrimethylene terephthalate (PTT) and aliphatic polyesters such as polylactic acid (PLA).

In one embodiment, the conjugate filaments present, in cross-section, a configuration of zones representing the cross-sections of the different elementary filaments in the form of wedges or triangular sections. Such a shape is clearly identifiable in the central area of FIG. 1, which shows a circular cross-section having narrow, dark wedges between wider wedges. The dark wedges represent the polyamide component of the conjugate filament, while the wider, lightly colored wedges represent the polyester component of the conjugate filament. As may be realized, the percentage of polyester in the conjugate filament is larger than the percentage of polyamide. Distributions of polyester to polyamide range from 95–5 to 5–95, with 65–35 being a typical distribution by weight.

A review of FIG. 1 shows a plurality of polyester wedges that have been dislodged from their multi-component "packages." Slightly above and to the left of the central circular package is a cross-section in which some polyester wedges have been dislodged, but the polyamide skeleton remains largely intact. A similar structure, but with more polyester wedges removed, is visible in the lower left corner of the photograph.

Several items should be noted, upon review of a representative photograph of the nonwoven's composition. First, while the core portions of the conjugate filaments are shown as polyamides, no core portion is required. In fact, hollow core conjugate filaments are also suitable for use in the present process, particularly since such hollow filaments are more likely to fully split. Furthermore, cores made of polyester or fibers without a recognizable "core" would be suitable as well.

Second, it should be noted that FIG. 1 is a photograph of a piece of untreated nonwoven fabric. The fabric shown in FIG. 1 was processed as described above, by extruding a web and then consolidating the filaments of the web. The fabric was then subjected to the conditions of the present process, but without the addition of the acid or the basic treatment. That is, the fabric was tumbled in a jet dye machine for 90 minutes at 130° C., cooled, rinsed, tumbled in a jet dye machine for 30 minutes at 130° C., cooled, rinsed, and then dyed. From the photograph, it is clear that merely tumbling the fabric during processing does not affect the desired filament splitting.

The object of the consolidation process is to fully split the different elementary filaments from one another. It is clear from the photograph that some multiple-component filaments remain. The fact that hydroentanglement alone is insufficient to separate the elementary filaments points to a need for additional processing, as is described herein.

Finally, the photograph shows a symmetrical cross-section of the conjugate filament, having a central median axis. In fact, the median axis of the conjugate filament can be positioned at a point other than the central line of the filament. The conjugate filament can be unsymmetrical, having elementary filaments with non-uniform cross-sections. The cross-section of the conjugate filaments can be substantially circular in shape or can be comprised of multiple lobes that are joined at a central region. Another variation of the construction of splittable conjugate filaments are those having a cross-section in which ribbons, or fingers, of one component are positioned between ribbons, or fingers, of a second different component. Yet another variation includes either one or a plurality of elementary filaments of one material that are integrated in a surrounding matrix of a second different material.

It is understood in the art that polyamides, such as nylon, can be etched—that is, partially eroded—by subjecting such fibers to acidic solutions. One example of an etching treatment is found in U.S. Pat. No. 4,353,706 to Burns, Jr. et al., which is commonly owned and is hereby incorporated by reference. The objective of the present process, unlike that of Burns, Jr. et al., is not to produce a sculptured pile fabric, but to produce a fabric more capable of absorbing water.

Both strong and weak acids are useful in the present process. Examples of common strong acids include sulfuric, phosphoric, nitric, and hydrochloric acids. Weak acids may also be employed in the present process including organic acids, such as formic acid, and sulfonic acids, such as benzene sulfonic acid; naphthalene sulfonic acid; ortho-, meta-, and para-toluene sulfonic acids; and alkylated aromatic sulfonic acids wherein the alkyl group may be straight chain or branched chain and may contain from one to about 20 carbon atoms. Preferably, the weak acids useful in the present process have a $pK_A$ value of from about 0.1 to about 2.0, preferably from about 0.4 to about 1.0. More preferably, paratoluene sulfonic acid (PTSA) is often used for the present process, because of the relative ease with which its corrosive properties may be controlled.

To determine the necessary reaction conditions, one must consider the kinetics and diffusion processes involved in the reaction. In general, the mass transport rate of the acid or base reactant to the polymer, the reaction rate of the reactant with the polymer, and the mass transport rate of the degraded polymer out of the fiber matrix are factors which affect the rate of reaction. The mass transport rate of the reactants is largely affected by the concentration of the reactant, the temperature, and the rate of liquid movement during the reaction process. The introduction of phase transfer catalysts, which transfer reactants from the liquid interface into the polymer, can also affect the reaction rate. The reaction rate is generally proportional to the concentration of acid or base reactant, the concentration of the polymer reactant, the temperature during the reaction, and the presence of any catalyst. The rate of mass transport of degraded polymer is affected by the concentration of degraded polymer, temperature, rate of liquid movement during the reaction process.

It has been found that subjecting the fabric to either an acidic solution or a basic solution increase the treated fabric's ability to absorb water. However, subjecting the fabric to both an acidic solution and a basic solution results in a fabric having greatly enhanced absorption capacity.

A particularly effective range of concentrations, when using PTSA, are concentrations greater than about 1% of the weight of the bath (owb), though improvements in water absorbency have been realized with concentrations as low as about 0.25% owb. More preferably, when using PTSA, the range is from about 1% to about 3%, based on the weight of the bath. Most preferably, when using PTSA, the acid concentration is about 2%, based on the weight of the bath. Obviously, different concentrations may be desirable for different acid types, such as organic or strong.

Exposure times, again using PTSA, can range upwards from about 30 minutes to about 120 minutes. The preferred exposure time is about 90 minutes, when a 2% concentration of PTSA is used. Strong acids or higher acid concentrations would likely require a shorter exposure time, while organic acids might need longer periods over which to effect the desired fiber modifications.

The acid selectively targets the polyamide components of the nonwoven fabric. Where the conjugate filaments have been at least partially split during hydroentanglement, the acid tends to further split the filaments into their elementary components and to erode the polyamide components. This result is due to the acid's preferential affinity for polyamides. Where conjugate filaments are not split, there is a tendency for the polyamide components to be dissolved or eroded by the acid, while the relative grouping of the components may remain largely unchanged (see FIG. 2).

FIG. 2 is a photograph of a nonwoven fabric that has been subjected only to an acidic solution (where the acid concentration was about 2% owb). In the central area of the photograph, a composite structure is visible in which most of the polyamide components of the conjugate filament have been removed. Only three dark-colored polyamide components remain between the polyester components. Below and to the left of the central circular structure are individual polyester wedges that have been separated from neighboring polyamide wedges. Because of the concentration level used, there appear to be no individual polyamide wedges. The polyamide portions appear to have been completely eroded.

Due to the dissolution of at least some of the polyamide components of the fabric, the resulting fabric has a decreased weight, typically on the order of about 2 to about 25%. The resulting fabric also has improved water absorption characteristics, although those characteristics are further enhanced by a subsequent basic treatment as described below.

Following acid treatment, the fabric is then subjected to a basic treatment. The basic solution reacts with the polyester component of the conjugate filament, making it more hydrophilic. The term "basic" is intended to describe the hydroxides of any alkali or alkaline earth metal and amines. The preferred basic solutions are sodium hydroxide (NaOH) and potassium hydroxide (KOH), with sodium hydroxide being more preferred because of cost. Amines are less preferred because of their tendency to react with the entire fiber rather than the surface of the fiber.

Additionally, a phase transfer catalyst may be used to affect the reaction rate. Commonly, alkyl quaternary salts are used. Such salts often have a carbon chain length of about 16.

The preferred concentration for the basic solution is significantly less than that of the acidic solution. In fact, a concentration range from about 0.025% to about 0.10% (based on the weight of the bath) is sufficient to create the desired modifications in the polyester components. Preferably, the concentration of the basic solution is about 0.050% based on the weight of the bath. It has been found that higher concentration levels of the basic solution may be used. Such concentrations may result in a weakened fabric, loss of textile quality, and resemblance to a paper-type product.

Exposure times, using sodium hydroxide, can range from about 15 minutes to about 90 minutes. The preferred exposure time is about 30 minutes, when a 0.050% owb concentration of sodium hydroxide is used. The base selectively targets the polyester components of the fabric and, specifically, the ester groups. The base hydrolizes the ester bonds in the polyester, creating hydrophilic cites. These cites make the polyester more hydrophilic and the surface of the polyester becomes more water-loving.

Again, the fabric that has been treated only with base has improved water absorption characteristics as compared with the untreated fabric, although the improvements are not as significant as those realized with a combination of acid and basic treatments. FIG. 3 is a photograph of a nonwoven fabric, as described herein, in which the fabric has been subjected only to a basic solution. In this photograph, a number of joined polyamide clusters are visible. Individual polyester wedges seen in earlier photographs are also present and separate from the polyamide skeletons. As compared with FIG. 2, there appears to be little, if any, degradation in the polyamide component. This is expected because the basic solution targets only the polyester component.

It has been found that the combination of successive acid and basic treatments imparts the most desired characteristics to the treated fabric. Functionally, the nonwoven fabric, having been treated with both acid and base, is significantly better at absorbing water than (a) the untreated fabric, (b) the fabric treated only with acid, and (c) the fabric treated only with base. Structurally, the treated fabric contains a plurality of fully split conjugate yarns, having individualized polyester components and degraded individualized polyamide components, and a plurality of polyamide "skeletons." The term "polyamide skeletons" is intended to describe a structure comprised of polyamide components that are joined to one another. In some yarn configurations, when treated, these polyamide skeletons tend to fold over onto themselves.

Figure 4:
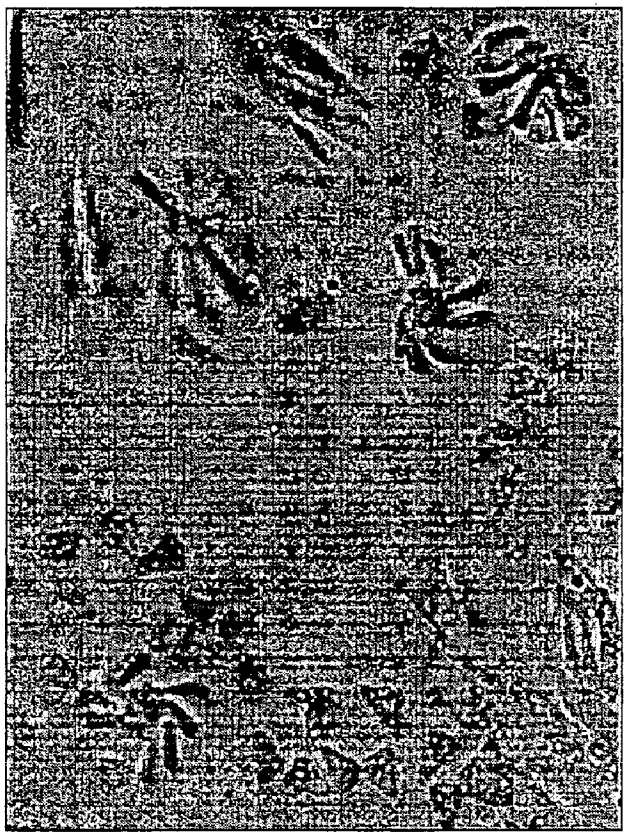
FIG. 4 is a photograph, taken by an optical microscope at a magnification of 1060×, of a nonwoven fabric that has been subjected to a 0.25% acidic treatment and a basic treatment.

FIG. 4 is a photograph of a cross-section of nonwoven fabric that has been subjected to a 0.25% owb acid solution and a 0.050% owb basic solution. The photograph shows a plurality of individual polyester wedges, some of which are slightly squared off on the sides that were arc-shaped. Slightly to the left of the center of the photograph, a polyamide cluster is visible. Some parts of the polyamide skeleton appear to be degraded, not having the full width and shape of their original form. The polyamide skeletons experience reconfiguration due to the present process. Reconfiguration may be interpreted to mean (a) separation of the skeleton into at least two parts; (b) separation of the skeleton into at least two parts, in which at least one part has been dissolved; and (c) removal of at least a portion of the skeleton, particularly in which removal is at least partially due to dissolution.

Figure 5:
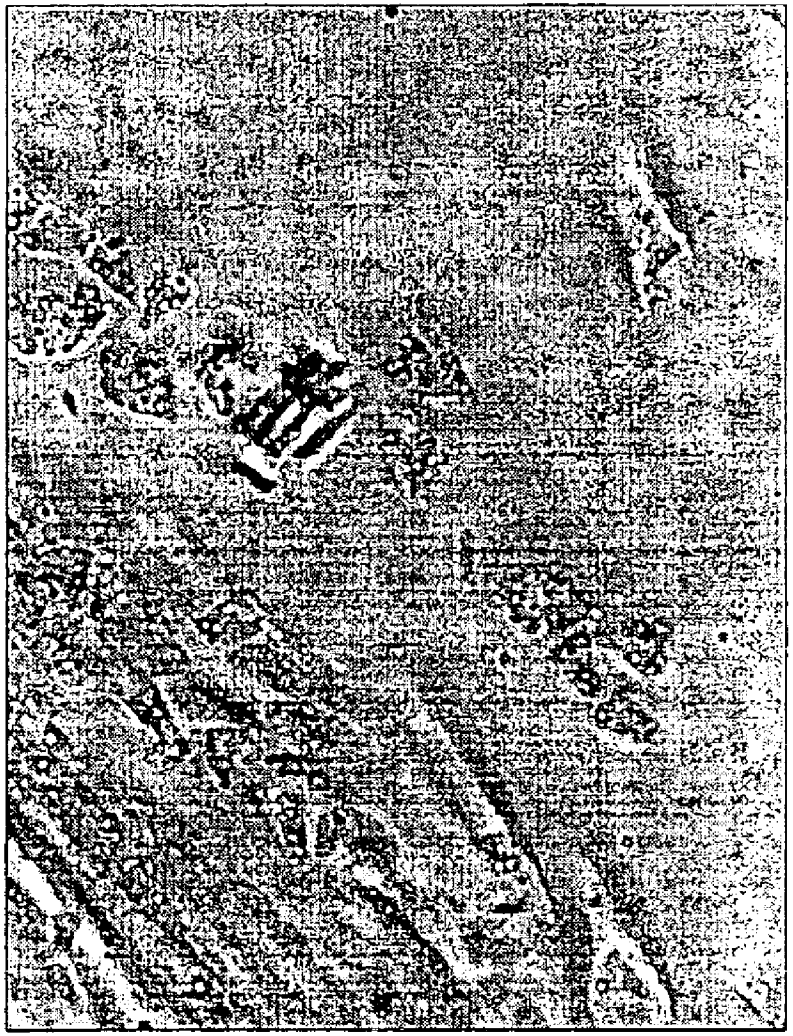
FIG. 5 is a photograph, taken by an optical microscope at a magnification of 1060×, of a nonwoven fabric that has been subjected to a 2.0% acidic treatment and a basic treatment.

FIG. 5 is a photograph of a cross-section of nonwoven fabric that has been subjected to a 2.0% owb acid solution and a 0.050% owb basic solution. The photograph shows a plurality of polyester wedges and only a small polyamide cluster in the central area of the photograph. As compared with that of FIG. 4, the fabric of FIG. 5 has much less polyamide remaining. The polyamide components have been removed by the higher concentration of acid. For example, in a fabric having a 65–35% polyester-polyamide composition, removal levels of polyamide vary upwards from 50%. For best results, in terms of water absorption, at least 75% of the polyamide should be removed.

After treating with acid and base, the nonwoven fabric may be dyed using conventional dyeing techniques. Other finishing chemicals may be added, for example, to improve the hand or soil release characteristics of the fabric.

The process steps will now be discussed in more detail. In a preferred embodiment, the acid treatment step is conducted in a jet-dyeing machine, into which the fabric is fed, along with an acid solution containing about 2.0% PTSA (based on the weight of the bath). The temperature of the bath is raised to approximately 130° C. and held for an exposure time of about 90 minutes. It is believed that temperatures as high as 150° C. would also be acceptable. After the necessary time, the fabric is cooled, preferably to at least 60° C. It is then rinsed, preferably twice, with water to prevent reaction between the acid and the base, which will be used in the next step.

The fabric, having been treated with acid, may then be treated with base. The fabric is fed into a jet-dyeing machine along with a basic solution containing about 0.050% sodium hydroxide (based on the weight on the bath). The temperature of the bath is raised to approximately 130° C. After an exposure time of about 30 minutes, the fabric is then cooled to about 50° C. and rinsed, preferably twice, with water.

Other finishing chemicals can be applied to the treated fabric, including soil release agents, wetting agents, and hand-building agents. One particularly preferred additive is a high molecular weight ethoxylated polyester, sold under the trade name Lubril QCX, by Rhone Poulenc, which improves both the hand and the soil release characteristics of the fabric. Such chemicals are effectively applied in a padding operation, although other application techniques may be employed. By way of example only, a 3% concentration of Lubril QCX was found to improve the hand and soil release characteristics of the fabric, without negatively impacting the fabric's ability to absorb water.

The phrase "absorption capacity" is intended to describe the capacity of the fabric to absorb water. The capacity is measured as milliliters of water per gram of fabric. The untreated nonwoven fabric described herein has an absorption capacity of about 3.5 ml/g. The nonwoven fabric of the present product, having been subjected to acidic and basic treatments, has an absorption capacity of about 7.0 ml/g, an improvement of about 200%. The nonwoven fabric of the present product, having been subjected to high pressure hydroentanglement, acidic treatment, and basic treatment, has an absorption capacity of about 6.2 ml/g.

TABLE 1 shows the results of several trials, conducted according to the process steps described herein.

TABLE 1

Absorption Capacity Testing with Various Treatments

| Treatment | Acid Concentration (% owb) | Acid Exposure Time (minutes) | Base Concentration (% owb) | Absorption Capacity (ml/g) | % Improvement (vs. untreated) |
|---|---|---|---|---|---|
| None | 0 | 0 | 0 | 3.52 | n/a |
| Dyed | 0 | 0 | 0 | 3.82 | 109 |
| NaOH only | 0 | 0 | 0.050 | 4.38 | 124 |
| PTSA/NaOH | 0.25 | 30 | 0.050 | 4.30 | 122 |
| PTSA/NaOH | 0.50 | 30 | 0.050 | 4.43 | 126 |
| PTSA/NaOH | 1.0 | 60 | 0.050 | 4.58 | 130 |
| PTSA/NaOH | 1.0 | 90 | 0.050 | 5.07 | 144 |
| PTSA/NaOH | 2.0 | 30 | 0.050 | 4.82 | 137 |
| PTSA/NaOH | 2.0 | 60 | 0.050 | 5.11 | 145 |
| PTSA/NaOH | 2.0 | 90 | 0.050 | 6.31 | 179 |
| PTSA/NaOH | 2.5 | 90 | 0.050 | 6.76 | 192 |
| PTSA/NaOH | 2.5 | 120 | 0.050 | 7.04 | 200 |
| PTSA/NaOH | 3.0 | 120 | 0.050 | 6.71 | 191 |

The absorbent fabric described herein can be utilized for a variety of purposes. By way of example only, the absorbent fabric may be used as a drying cloth, as a wiping cloth, as part of a filtration system, or as any other product in which the fabric's absorbent characteristics may be beneficial.

We claim:

1. A process for improving the absorption characteristics of a fabric, the fabric being comprised of continuous conjugate filaments that are longitudinally separable into elementary filaments and having at least a first elementary filament material and a second elementary filament material, wherein said first filament material is a polyester that is substantially resistant to acid degradation and said second filament material is a polyamide that is susceptible to acid degradation, said process comprising the steps of:

(a) subjecting the fabric to an acid-containing solution for a first determinate time and then rinsing, wherein the acid-containing solution degrades at least a portion of said second filament material; and (b) subjecting the fabric to a basic solution for a second determinate time and then rinsing, wherein the basic solution makes said first filament material more hydrophilic.

2. The process of claim 1 wherein the acid-containing solution contains an acid that is selected from the group consisting of hydrochloric acid, sulfuric acid, nitric acid, and phosphoric acid.

3. The process of claim 1 wherein the acid-containing solution contains formic acid.

4. The process of claim 1 wherein the acid-containing solution contains a sulfonic acid is selected from the group consisting of benzene sulfonic acid, naphthalene sulfonic acid, orthotoluene sulfonic acid, metatoluene sulfonic acid, paratoluene sulfonic acids, and alkylated aromatic sulfonic acids wherein the alkyl group may be a straight chain or branched chain and may contain from one to about 20 carbon atoms.

5. The process of claim 4 wherein the sulfonic acid is paratoluene sulfonic acid.

6. The process of claim 5 wherein the concentration of paratoluene sulfonic acid in the acidic solution is from about 0.25% to about 3.0%, based on the weight of the bath.

7. The process of claim 6 wherein the concentration of paratoluene sulfonic acid in the acidic solution is from about 1.0% to about 3.0%, based on the weight of the bath.

8. The process of claim 7 wherein the concentration of paratoluene sulfonic acid in the acidic solution is about 2.0%, based on the weight of the bath.

9. The process of claim 4 wherein the first determinate time is from about 30 minutes to about 120 minutes.

10. The process of claim 9 wherein the first determinate time is about 90 minutes.

11. The process of claim 1 wherein the basic solution contains a base selected from the group of the hydroxides of alkali metals, the hydroxides of alkaline earth metals, and amines.

12. The process of claim 11 wherein the basic comprises potassium hydroxide.

13. The process of claim 11 wherein the basic comprises sodium hydroxide.

14. The process of claim 13 wherein the concentration of sodium hydroxide in the basic solution is from about 0.025% to about 0.10%, based on the weight of the bath.

15. The process of claim 14 wherein the concentration of sodium hydroxide in the basic solution is about 0.050%, based on the weight of the bath.

16. The process of claim 1 wherein the second determinate time is about 30 minutes.

17. The process of claim 1 wherein the fabric is further subjected to application of a hand-building agent after step (b).

18. The process of claim 1 wherein the fabric is further subjected to application of a soil-release agent after step (b).

19. The process of claim 1 wherein the fabric is subjected to high pressure hydroentanglement before step (a).

20. The process of claim 1 wherein said polyester material is selected from the group consisting of polyethylene terephthalate (PET), polybutylene terephthalate (PBT), polytrimethylene terephthalate (PTT), and polylactic acid (PLA).

21. The process of claim 20 wherein said polyester material is polyethylene terephthalate (PET).

22. The process of claim 1 wherein said polyamide material is selected from the group consisting of nylon 6, nylon 66, nylon 11, and nylon 610.

23. The process of claim 22 wherein said polyamide material is nylon 6.

24. The process of claim 1 wherein the fabric has a nonwoven construction.

* * * * *